United States Patent [19]

Krause et al.

[11] 4,265,681

[45] May 5, 1981

[54] METHOD OF PRODUCING LOW LOSS PRESSED MAGNETIC CORES FROM MICROLAMINATIONS

[75] Inventors: Robert F. Krause, Murrysville; Norman M. Pavlik, Plum Boro; Kurt A. Grunert, Beaver, all of Pa.

[73] Assignee: Westinghouse Electric Corp., Pittsburgh, Pa.

[21] Appl. No.: 60,942

[22] Filed: Jul. 26, 1979

Related U.S. Application Data

[63] Continuation-in-part of Ser. No. 896,525, Apr. 14, 1978, abandoned.

[51] Int. Cl.[3] ..... H01F 1/04

[52] U.S. Cl. ..... 148/111; 75/208 R; 75/213; 148/31.55; 148/104; 148/120; 148/126

[58] Field of Search ..... 148/104, 105, 108, 110, 148/111, 112, 113, 121, 122, 31.55, 31.57, 126; 29/596; 75/208 R, 213

[56] References Cited

U.S. PATENT DOCUMENTS

| | | | |
|---|---|---|---|
| 2,937,964 | 5/1960 | Adams et al. | 148/105 |
| 2,977,263 | 3/1961 | Harendza-Harinxma | 148/104 |
| 3,014,825 | 12/1961 | Harendza-Harinxma | 148/104 |
| 3,235,675 | 2/1966 | Blume | 179/115 |
| 3,255,052 | 6/1966 | Opitz | 148/105 |
| 3,418,710 | 12/1968 | Seidel et al. | 148/113 |
| 3,498,918 | 3/1970 | Copp | 252/62.55 |
| 3,848,331 | 11/1974 | Paulik et al. | 148/105 |
| 3,948,690 | 4/1976 | Paulik et al. | 148/105 |
| 4,158,561 | 6/1979 | Paulik et al. | 148/105 |
| 4,158,580 | 6/1979 | Reynolds et al. | 148/105 |
| 4,158,581 | 6/1979 | Krause et al. | 148/105 |
| 4,158,582 | 6/1979 | Krause | 148/120 |

*Primary Examiner*—L. Dewayne Rutledge
*Assistant Examiner*—John P. Sheehan
*Attorney, Agent, or Firm*—L. P. Johns

[57] ABSTRACT

A method for making pressed magnetic components having a low core loss characterized by the steps of compacting a plurality of substantially rectangular particles of an oriented iron alloy having a silicon content of from about 2.5% to about 3.5% and a carbon content of up to 0.01% into a compact of predetermined configuration, and stress-relief annealing the compact in a non-oxidizing atmosphere so as to provide a magnetizable compact having low core loss.

12 Claims, 3 Drawing Figures

METHOD OF PRODUCING LOW LOSS PRESSED MAGNETIC CORES FROM MICROLAMINATIONS

CROSS-REFERENCE TO RELATED APPLICATIONS

This is a continuation-in-part of application Ser. No. 896,525, filed Apr. 14, 1978, now abondoned.

This invention is related to the copending Application Ser. No. 896,534, filed Apr. 14, 1978, by R. F. Krause and Norman Pavlik; (now U.S. Pat. No. 4,158,581) Ser. No. 896,526, filed Apr. 4, 1978, by R. F. Krause; (now U.S. Pat. No. 4,158,582) Ser. No. 896,533, filed Apr. 14, 1978, by N. Pavlik and John Sefko; (now U.S. Pat. No. 4,158,561) Ser. No. 896,535, (now U.S. Pat. No. 4,158,580) filed Apr. 4, 1978, by William Reynolds and N. Pavlik; and Ser. No. 896,536, filed Apr. 14, 1978, by R. F. Krause, N. Pavlik and C. Eaves.

BACKGROUND OF THE INVENTION

1. Field of the Invention

This invention relates to a method of making a magnetic core having a significantly low core loss, and more particularly, it pertains to a method for using oriented silicon iron alloy particles which when insulated, compacted and annealed provide a magnetic core exhibiting a very low core loss.

2. Description of the Prior Art

The term "microlamination" which has been defined in U.S. Pat. Nos. 3,848,331 and 3,948,690, and in general terms relates to a small rectangular particle of low carbon steel, when processed in a specific manner, is capable of being formed into a magnetic core or compact possessing soft magnetic characteristics which are useful in a myriad of applications, for example a light ballast, and as shown in U.S. Pat. No. 3,235,675. A typical low carbon steel comprises about 0.10% C, less than 0.04% S, less than 0.60% Mn, and about 0.10% Si; i.e., a grade of steel that is known as AISI Type 1010 steel in the trade. Generally, the processing of microlaminations include a decarburization, deoxidation, and stress relief anneal, the application of an insulating medium, and compaction of the microlaminations to a usable magetizable compact form. The method of compaction is either uniaxial or isostatic in nature. The resultant compact exhibits a core loss of nominally 5.25 to 7 watts per pound at an induction of 14 kG. When the compact is subsequently annealed to relieve stresses resulting from the prior compaction step, the core loss increases dramatically by a factor of from 2 to 10. For example, a ring core pressed at 125,000 psi from 0.060×0.010×0.006 inch particles of low carbon steel has a core loss of approximately 6.6 W/lb at 14 kG. After a 10 minute stress relief anneal at 700° C. in dry hydrogen, the core loss is increased to approximately 33.2 W/lb at 14 kG. Manifestly, the impairment of the loss characteristics is intolerable.

SUMMARY OF THE INVENTION

It has been found in accordance with this invention that the lower core loss properties are obtainable by a method of making pressed magnetic core components for use in electrical apparatus, comprising the steps of providing microlaminations from an oriented silicon steel alloy sheet having a silicon content of from about 2.5% to about 3.5% and a carbon content of up to 0.010%, annealing the microlaminations in a deoxidizing atmosphere to avoid formation of a heavy oxide, coating the microlaminations with a dielectric material, assembling the coated microlaminations within a container of a predetermined configuration, compacting the microlaminations under pressure into a magnetizable compact, and annealing the compact for about 4 hours at about 925° C. in a deoxidizing atmosphere to relieve compaction stresses.

Oriented silicon steel sheet has a thin special insulative coating of silicate glass on the two major sheet surfaces. The coatings have a thickness of less than 10% of the total sheet thickness and comprise primarily magnesium-silicate glass.

The advantage of the method of this invention is that the effect of a core annealing treatment is unexpectedly different from that found for low carbon steel (AISI Type 1010) microlaminations, and that significantly lower core losses are obtained when an iron alloy material having a silicon content of from about 2.5% to about 3.5% and a carbon content of less than 0.01% is used.

DESCRIPTION OF THE PREFERRED EMBODIMENT

Figure 1:
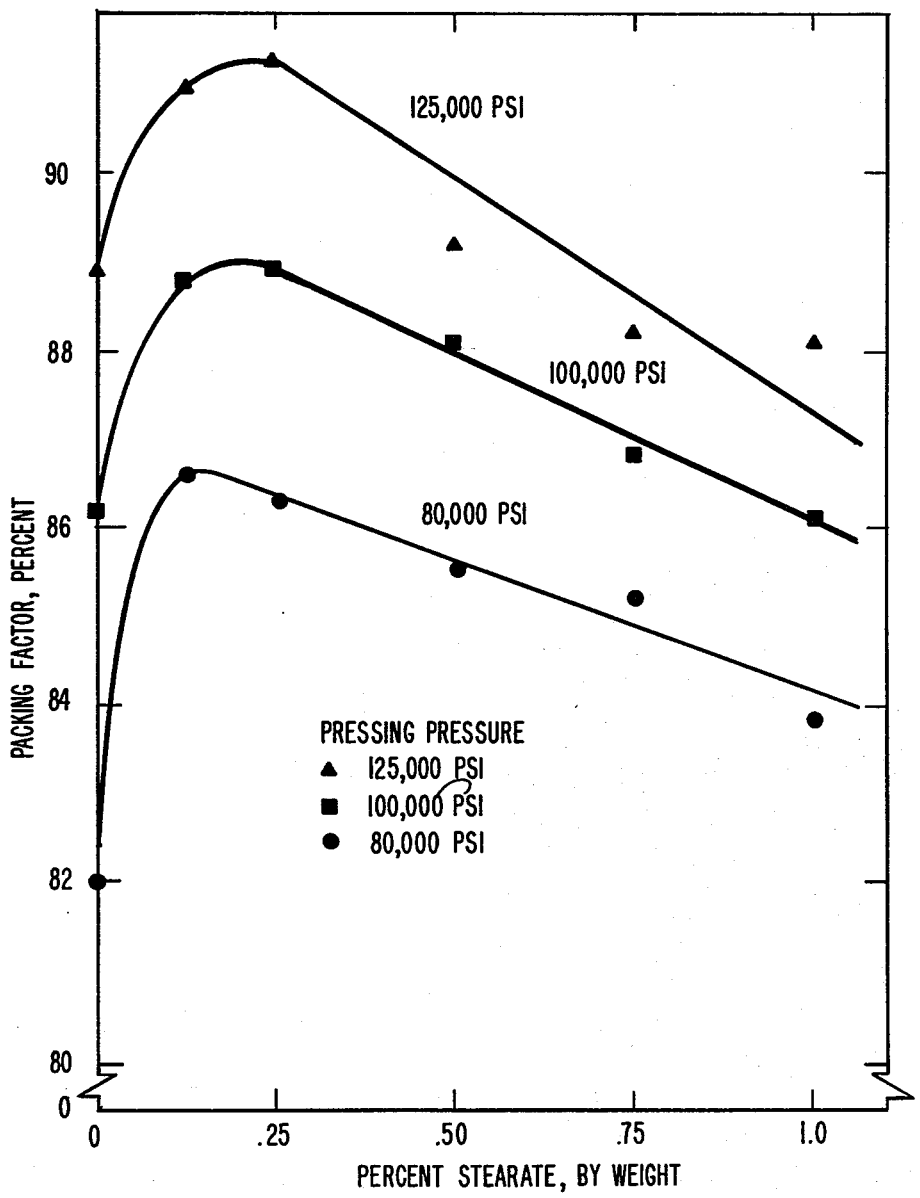
FIG. 1 is a graph illustrating the effect of stearate additions on density of uniaxially pressed iron-silicon scrap compacts.

A very high usage of oriented silicon steel alloy containing about 2.5% and about 3.5% silicon with less than 0.01% carbon is found in the electrical apparatus industry. This material is processed in such a manner that there exists a predetermined crystallographic orientation in the material as commercially processed. This orientation is usually of the (110) [001] character as described by Miller Indicies, that is, the (110) plane is aligned in the [001] direction, which is the rolling direction. Thus there are three different axes of magnetization, each of different magnitude insofar as the ease of magnetization is concerned. By utilizing these geometry-dependent magnetic characteristics, the design engineers can employ this oriented material to obtain a product having the optimum electrical characteristics at the lowest cost. Consequently, the fact that the core material is oriented is essential to the foregoing considerations.

The oriented material as above described is further characterized by being in the secondary recrystallized condition in which the enormous grain growth marks the grain size readily discernible with the naked eye. Thus, the larger the grain size, the better the magnetic characteristics, especially core loss since the eddy current component of the core loss decreases with increasing grain size. Typically a single grain may measure 1 inch in the rolling direction by the thickness of the rolled product.

In contrast thereto, the present invention is directed to the use of microlaminations which have dimensions which are only a fraction of the size of a single grain of the oriented material described previously. Most advantageously, the microlaminations to which the process of the present invention is applicable take the form of "saw chips" which are generated during the manufacture of wound cores for distribution transformers. Thus the technology employed for making cores for transformers employing oriented material and the technology for forming magnetic cores from microlaminations from the same materials is not synonymous. Moreover, due to the size and method of making the magnetic cores from microlaminations, the possibility of gainfully employing the orientation characteristics is indeed remote.

According to the present invention the new method is carried out in the following preferred sequential manner:

1. Providing silicon-iron alloy sheet stock having a thin coating of silicate glass on two opposite sides thereof;
2. Forming microlaminations from the silicon-iron alloy sheet stock which microlaminations comprise a coating of silicate glass on two opposite sides thereof;
3. Annealing the microlaminations in a deoxidizing atmosphere;
4. Coating the microlaminations with an electrically insulating material;
5. Assembling the microlaminations within a container of predetermined configuration;
6. Compacting the microlaminations into a magnetizable compact; and
7. Annealing the compact in a deoxidizing atmosphere to relieve stresses.

The foregoing method is applicable to so-called "silicon steels" and preferably "oriented silicon steels". The silicon steels operable for this invention comprise iron alloys having a silicon content of from about 2.5% to about 3.5%, a carbon content of up to 0.01%, manganese from about 0.01% to 0.2%, and sulfur in the amount of 0.005% to 0.05%. A more workable silicon content is from about 2.75% to 3.3%, and a preferred silicon content is about 3.2%.

In accordance with this invention the silicon steel sheet comprises a thin coating or layer of a silicate glass on each side having a thickness of less than 10% and preferably less than 3% of the total thickness of the coated sheet. The uncoated sheet may have a thickness of from about 0.002 to about 0.025 inch and a preferred thickness of from about 0.004 to about 0.015 inch. The thin coating is an insulative layer on each side of the sheet and comprises a glass-like material, such as a silicate glass. The insulative coating is a tightly adhering film of magnesium-silicate glass having electrically insulative properties suitable for transformer applications.

The first step comprises the provision or cutting of microlamination particles involved in the subsequent steps of this method. Though a relatively wide range of particle sizes and thicknesses appears to be satisfactory, it is preferred to have the microlaminations formed with the length ranging between about 0.05 inch and about 0.150 inch, a width of between 0.01 inch and 0.02 inch, and a thickness of between 0.005 and about 0.014 inch. The microlaminations are formed with a high speed rotary cutter operating on feedstick sheets. However, as is pointed out, saw chips normally scrapped and produced during the fabrication of wound cores assembled on a mandrel and then sawed open are also suitable. The resulting microlaminations are nominally rectangular particles having six sides of which two sides have the layer of glass-like material on them.

The second step comprises heating the microlamination particles to relieve the stresses imparted in the steel during the formation of the microlamination. Essentially, the heating is a stress-relief anneal in a nonoxidizing atmosphere so that the core structure of a high density or packing factor can be obtained that ultimately exhibits excellent magnetic characteristics. It is preferred to anneal the microlaminations at a temperature within the range between about 700° C. and 1000° C. This temperature range is sufficient for relieving the stresses in the microlaminations induced during the first step of cutting the particles from feedstock. Although this step is recommended in order to achieve the optimum magnetic characteristics it is not an essential step in the process. It will however recover optimum ductility so that greater density and packing factors are obtained.

The third step comprises coating all surfaces of the microlaminations with an electrically insulating material. The microlaminations are preferably insulated from each other in order to provide the required core loss characteristics within the finished core. Magnesium methylate is a preferred medium for providing an insulating coating on the laminations because such coating is very thin and is sufficiently flexible to withstand the molding pressures. Though other insulating coatings may be employed, this coating provides sufficient interlaminar resistance to maintain the required core loss as well as other magnetic characteristics. As applied, this coating covers all surfaces of the microlaminations including the two sides having the layers of glass-like material.

The fourth step consists of assembling the microlaminations within a container of a suitable configuration adapted for a predetermined form.

The fifth step comprises compacting the microlaminations into a magnetizable compact at pressures of from 50,000 to 125,000 psi.

The sixth and final step comprises annealing the compact to primarily relieve the stresses incurred in the microlaminations during the preceding compacting step.

Two types of particles of "oriented silicon steel" were investigated including rectangular particles produced by shearing and chopping of sheet stock, and saw chip scrap generated during the manufacture of magnetic cores. Both types of particles had essentially the same chemical composition.

A reduction in core loss was observed when pressed saw chip scrap was annealed. A quantity of scrap was ball milled to separate the individual particles and remove the greater part of the saw kerf, stress relief annealed, coated with magnesium methylate, and uniaxially pressed at 125,000 psi. The 10 kG core loss was 4.3 W/lb. The compact was then annealed for 4 hours at 925° C. in a dry hydrogen atmosphere and retested. The 10 kG core loss was reduced to 1.7 W/lb.

Similarly, microlaminations having dimensions of 0.060×0.010×0.011 inch, were made by shearing and chopping from a 4 inch wide strip of oriented silicon steel strip material. The particles were stress relief annealed for 1 hour at 800° C. in a dry hydrogen atmosphere, coated with magnesium methylate, and uniaxially pressed into a test ring core at a pressure of 125,000 psi. The 10 kG core loss of the as-pressed core was about 3.1 W/lb. The core was subsequently annealed for 4 hours at 925° C. in a dry hydrogen atmosphere after which the 10 kG core loss was reduced to approximately 1 W/lb.

The foregoing results made in the pressed and annealed cores are opposite to what had been previously observed when standard low carbon steel microlamination compacts were annealed. More particularly, the following examples are illustrative of the invention.

EXAMPLE 1

Several hundred pounds of oriented iron-silicon saw chips, which result from the core cutting operation, were received and subsequently degreased. Large strips of the scrap (greater than 1 inch in length) and miscellaneous non-magnetic debris were removed from the batch and four 5-pound (2300 grams) sample lots were taken. Processing of the four lots consisted of a combination of ball-milling for two hours to break up the nested saw chips and remove the rough edges followed by stress relief annealing (1 hour at 800° C. in dry hydrogen and furnace cooled). In this condition, two of the six sides had the thin layers of glass-like material. After processing, all four lots were coated with magnesium methylate and all six surfaces to insulate the individual particles. Twenty-four magnetic test rings, 6 from each lot, were then uniaxially pressed at a pressure of 125,000 psi (862 MPa). The die wall was cleaned and coated with a zinc stearate lubricant before each pressing.

The test rings, which measured 25.4 mm ID, 4.45 mm OD, and approximately 12 mm in height, were then annealed at various temperatures for four hours in a dry hydrogen atmosphere and furnace cooled. More specifically, one ring from each sample lot was annealed at a temperature of 870° C., 925° C., 980° C., 1040° C., and 1095° C. The remaining ring from each lot was left in the as-pressed condition. The packing factor was determined for all rings, and the ac and dc magnetic characteristics, core loss ($P_c$/10 kG), permeability (M/10 kG), coercive force ($H_c$), and remanence ($B_r$) were measured.

EXAMPLE II

Previous work has shown that the magnetic characteristics, particularly permeability, are strongly dependent upon the density (packing factor or P.F.) of the microlamination compact due to magnetostatic interactions between the particles as well as to the effect of compact density on the apparent saturation magnetization of the sample. Therefore, an attempt was made to improve the density of the Hipersil scrap compacts by adding particle lubricants to the loose chips prior to pressing. Hipersil is a trademark of Armco, Inc. and designates a class of oriented silicon steel alloys having a silicon content range of from about 2.5% to about 3.5%. Microlamination scrap particles, which had previously been ball-milled, stress-relief annealed and coated, were blended with various fractions (0, $\frac{1}{8}$, $\frac{1}{4}$, $\frac{1}{2}$, $\frac{3}{4}$, and 1 percent by weight) of zinc stearate lubricant and uniaxially pressed at pressures of 80,000, 100,000, and 125,000 psi (552,689, and 862 MPa). After pressing, the rings were baked out for one hour at 425° C. to drive off the stearate, then annealed for 1 hour at 925° C. in dry hydrogen, furnace cooled, wound, and tested.

EXAMPLE III

Sheet samples of fully-processed 11-mil (0.28 mm) thick oriented silicon steel were cut into strips 4 in. (100 mm) wide and approximately 4 ft. (91 cm) in length, slit, and chopped into microlamination particles of dimensions 0.060×0.010×0.011 inch. A 90-gram sample of this material was stress relief annealed for 1 hour at 800° C. in dry hydrogen, furnace cooled, coated with magnesium methylate, and uniaxially pressed into a test ring at 125,000 psi (862 MPa). The ring was annealed, (4 hours, 925° C. in dry hydrogen, furnace cooled). The dependence of the core loss on magnetizing frequency of the annealed ring was investigated by measuring the ac magnetic characteristics at frequencies of 30, 40, 60, 200, 400, 100 and 2000 Hz.

RESULTS AND DISCUSSION

Oriented Silicon Steel Scrap

The effect of pre-annealing, ball-milling, and annealing treatments on the dc and 10 kG ac magnetic characteristics of the pressed oriented silicon steel scrap compacts is shown in Table I. The magnetic characteristics of the as-pressed test samples compacted from unannealed scrap chips are significantly poorer than those of the stress relief annealed and pressed particles. For example, the core loss of the as-pressed rings compacted from unannealed chips is approximately double the loss of the rings compacted from annealed particles. This large difference in core loss is due to the highly strain-hardened condition of the unannealed chips. Although strain hardening, due to the saw cutting operation, will decrease the density of the compact at any fixed pressing pressure and thus increase the core loss, the intrinsic magnetic characteristics of the scrap chips is usually impaired to a great degree by strain hardening. Thus, these two interrelated effects result in the poor magnetic quality of the compacts pressed from unannealed saw chips.

TABLE I

Effect of Processing and Annealing on the Magnetic Properties of Hipersil Scrap Ring Cores (125,000 psi Pressing Pressure)

| Post Annealing Treatment | Processing Treatment Prior To Compaction | | | | |
|---|---|---|---|---|---|
| | P.F.* (%) | $P_c$/10 kg (W/lb) | $\mu$/10 kG | $H_c$+ (Oe) | $B_r$+ (kG) |
| | Ball Mill Plus Stress Relief Anneal | | | | |
| None | 90 | 4.3 | 145 | 3.8 | 1.6 |
| 4 hrs- 870 C | 89 | 2.0 | 187 | 0.6 | 0.7 |
| 4 hrs- 925 C | 89 | 1.7 | 187 | 0.6 | 0.6 |
| 4 hrs- 980 C | 89 | 3.4 | 174 | 0.6 | 0.3 |
| 4 hrs-1040 C | 89 | 2.8 | 170 | 0.7 | 0.5 |
| 4 hrs-1095 C | 89 | 3.1 | 172 | 0.7 | 0.9 |
| | Stress Relief Anneal Only | | | | |
| None | 89 | 4.1 | 125 | 4.1 | 1.6 |
| 4 hrs- 870 C | 89 | 1.9 | 181 | 0.6 | 0.5 |
| 4 hrs- 925 C | 89 | 1.9 | 172 | 0.7 | 0.7 |
| 4 hrs- 980 C | 89 | 3.6 | 168 | 0.4 | 0.9 |
| 4 hrs-1040 C | 89 | 3.0 | 165 | 0.6 | 0.5 |
| 4 hrs-1095 C | 89 | 3.7 | 159 | 0.6 | 0.7 |
| | Ball Mill Only | | | | |
| None | 85 | 8.7 | 99 | 7.2 | 2.2 |
| 4 hrs- 870 C | 83 | 2.1 | 116 | 0.9 | 0.5 |
| 4 hrs- 925 C | 84 | 2.0 | 120 | 0.4 | 0.7 |
| 4 hrs- 980 C | 88 | 3.2 | 107 | 0.8 | 0.5 |
| 4 hrs-1040 C | 84 | 3.1 | 105 | 0.4 | 0.5 |
| 4 hrs-1095 C | 84 | 3.7 | 105 | 0.6 | 0.6 |
| | No Pre-Processing | | | | |
| None | 84 | 8.8 | 92 | 7.0 | 1.3 |
| 4 hrs.- 870 C | 84 | 2.2 | 112 | 0.6 | 0.5 |
| 4 hrs.- 925 C | 85 | 2.0 | 103 | 0.6 | 0.5 |
| 4 hrs.- 980 C | 84 | 3.5 | 96 | 0.4 | 0.7 |
| 4 hrs.-1040 C | 84 | 3.6 | 94 | 0.4 | 0.5 |

TABLE I-continued

Effect of Processing and Annealing on the Magnetic Properties of Hipersil Scrap Ring Cores (125,000 psi Pressing Pressure)

| Post Annealing Treatment | Processing Treatment Prior To Compaction | | | | |
|---|---|---|---|---|---|
| | P.F.* (%) | $P_c$/10 kg (W/lb) | $\mu$/10 kG | $H_c$+ (Oe) | $B_r$+ (kG) |
| 4 hrs.-1095 C | 84 | 3.9 | 98 | 0.6 | 0.6 |

*P.F.—Packing Factor (percent of theoretical density).
+ $H_c$ and $B_r$ determined from an applied field of 100 Oe.

The operation of ball-milling to break up the nested saw chips appears to have little effect on the overall magnetic quality of the pressed ring cores (Table I) although subsequent work has shown that ball-milling of the scrap chips significantly increases the loose packing density of the chips (an increase of approximately 30%) and insures a more uniform die fill and more consistent pressed parts. Therefore, ball-milling or similar processing, though not essential, is a recommended step for the optimization of the magnetic quality of a pressed compact.

The effect of annealing of the pressed scrap compacts is also illustrated in Table I. The magnetic characteristics, particularly core loss, are dramatically improved due to the relief of reintroduced residual stresses in the sample. This improvement is completely opposite to what is observed when low carbon steel microlaminations (AISI Type 1010) are annealed after compaction. When standard microlamination compacts, coated with magnesium methylate insulation, are annealed for any length of time and furnace cooled, the core loss increases 2–10 times above the loss measured on the test ring prior to the anneal. This increase in loss is postulated to be due to a breakdown of the insulation at points of particle contact in the compact. As a result, although hysteresis is reduced due to the reduction of residual stresses, increased eddy currents are generated in the sample which cause a significant increase in the total observed core loss. This increase in eddy current loss is significantly greater than the reduction of hysteresis loss and thus results in a significant increase in the total losses of the sample.

In accordance with this invention it has been found that the significant departure in the behavior of the core losses from the previous results of core-annealing is due to the insulation on the individual core particles. More particularly, the two larger sides (or surfaces) of each particle (microlamination) is coated with the magnesium silicate glass as well as with magnesium methylate. The other four smaller sides are coated only with magnesium methylate. As a result when the core is subsequently annealed (step six above), the composite coating of magnesium-silicate glass and the magnesium methylate on adjacent particles resists electrically breakdown due to rubbing of the adjacent coated particles in response to thermal expansions and contractions of the core structure. In other words, the composite coating provides the necessary interparticle insulation to resistance breakdown that otherwise would result in particle-to-particle electrical shorting and the attendent increase in eddy-current losses in the core.

The variation of core loss and permeability with post-annealing temperature (Table I) indicates that an apparent optimum in magnetic properties is developed after the 925° C. anneal which optimum is apparently independent of prior processing. A comparison of the magnetic characteristics of the annealed rings indicates that the stress relief anneal of the particles prior to the pressing operation is necessary if optimum properties, particularly permeability, are to be achieved. This is related to the higher density of the pre-annealed compacts and the effect of this density on the measured magnetic characteristics of the pressed rings (FIG. 1).

The effect of pressing pressure and the addition of a zinc stearate particle lubricant on the density of pressed Hipersil scrap ring cores is shown in FIG. 1, and the variation in magnetic quality presented in Table II.

TABLE II

Effect of Zinc Stearate Additions on the Magnetic Characteristic of Hipersil Scrap Chips+ (Post-Annealed 1 hr at 925 C.)

| Zinc Stearate (%) | P.F.* (%) | $P_c$/10 kG (W/lb) | $\mu$/10 kg | $H_c$ (Oe) | $B_r$ (kG) |
|---|---|---|---|---|---|
| | | Pressed at 80,000 psi | | | |
| 0 | 82.0 | 1.74 | 90 | 0.8 | 0.4 |
| ⅛ | 86.6 | 1.60 | 132 | 0.8 | 0.4 |
| ¼ | 86.3 | 1.56 | 128 | 0.7 | 0.5 |
| ½ | 85.5 | 1.56 | 123 | 0.6 | 0.4 |
| ¾ | 85.2 | 1.56 | 122 | 0.7 | 0.5 |
| 1 | 83.8 | 1.53 | 109 | 0.7 | 0.4 |
| | | Pressed at 100,000 psi | | | |
| 0 | 86.2 | 1.64 | 125 | 0.8 | 0.5 |
| ⅛ | 88.8 | 1.53 | 155 | 0.7 | 0.6 |
| ¼ | 88.9 | 1.52 | 146 | 0.5 | 0.6 |
| ½ | 88.1 | 1.50 | 138 | 0.8 | 0.5 |
| ¾ | 86.8 | 1.55 | 129 | 0.6 | 0.5 |
| 1 | 86.1 | 1.59 | 108 | 0.7 | 0.4 |
| | | Pressed at 125,000 psi | | | |
| 0 | 88.9 | 1.51 | 157 | 0.9 | 0.6 |
| ⅛ | 91.0 | 1.50 | 184 | 0.9 | 0.6 |
| ¼ | 91.3 | 1.46 | 171 | 0.9 | 0.6 |
| ½ | 89.3 | 1.46 | 146 | 0.7 | 0.4 |
| ¾ | 88.2 | 1.47 | 134 | 0.8 | 0.4 |
| 1 | 88.1 | 1.47 | 134 | 0.8 | 0.4 |

+ Prior to blending with stearate the scrap was ballmilled, stress-relief annealed, and coated.

FIG. 1 shows that the addition of a very small percentage of zinc stearate significantly alters the density of the pressed compacts, with the greatest benefit occuring with the addition of ⅛ to ¼% lubricant. The relative improvement of the density with lubrication decreases with increasing pressing pressure. The addition of ⅛% stearate to a compact pressed at 80,000 psi (552 MPa) increases the packing factor from 82 to 86.5% or a change of 4.5 percentage points, whereas ⅛% stearate addition to a compact pressed at 125,000 psi (862 MPa) resulted in an increase in the density of only 2.3 percentage points. As the percentage of stearate is increased above the ⅛ to ¼% optimum, the compact density begins to decrease because the stearate begins to consume an ever increasing volume in the compact, thus decreasing the overall sample density.

Figure 2:
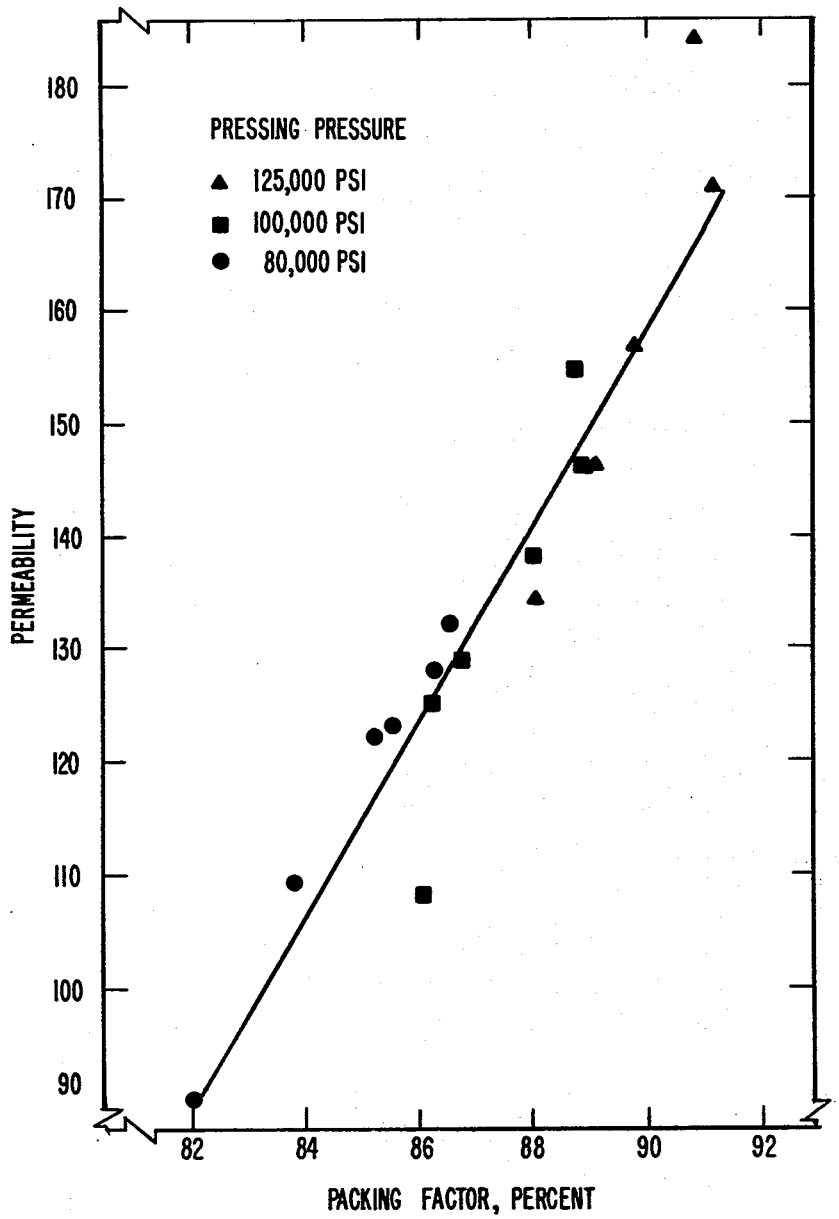
FIG. 2 is a graph illustrating the effect of packing factor on 10 kG permeability of iron-silicon scrap compacts after 925° C. anneal.

The magnetic characteristics of the compacts pressed with the addition of the zinc stearate and subsequently stress relief annealed for 1 hour at 925° C. are shown in Table II. The core loss, as well as the permeability, is improved as the density increases, regardless of whether the increase in density was achieved by increasing the pressing pressure or by the addition of a particle lubricant. Although the relationship between the density and the core loss is not particularly significant, the change in permeability with increased density is. This relationship is shown in FIG. 2.

Oriented Silicon Steel Microlaminations

The magnetic characteristics of oriented silicon steel microlaminations produced by slitting and chopping which were thereafter annealed, coated, pressed into a test ring core, and annealed for four hours at 925° C., are significantly better than those of the cores pressed from the oriented silicon steel saw chip scrap which were processed in a similar manner. The 10 kG loss and permeability of the microlamination compact were 1.0 W/lb (0.45 W/kg) and 211 respectively, compared to 1.7 W/lb (0.77 W/kg) and 187 measured on the best scrap test ring produced from saw chip scrap (Table I).

Figure 3:
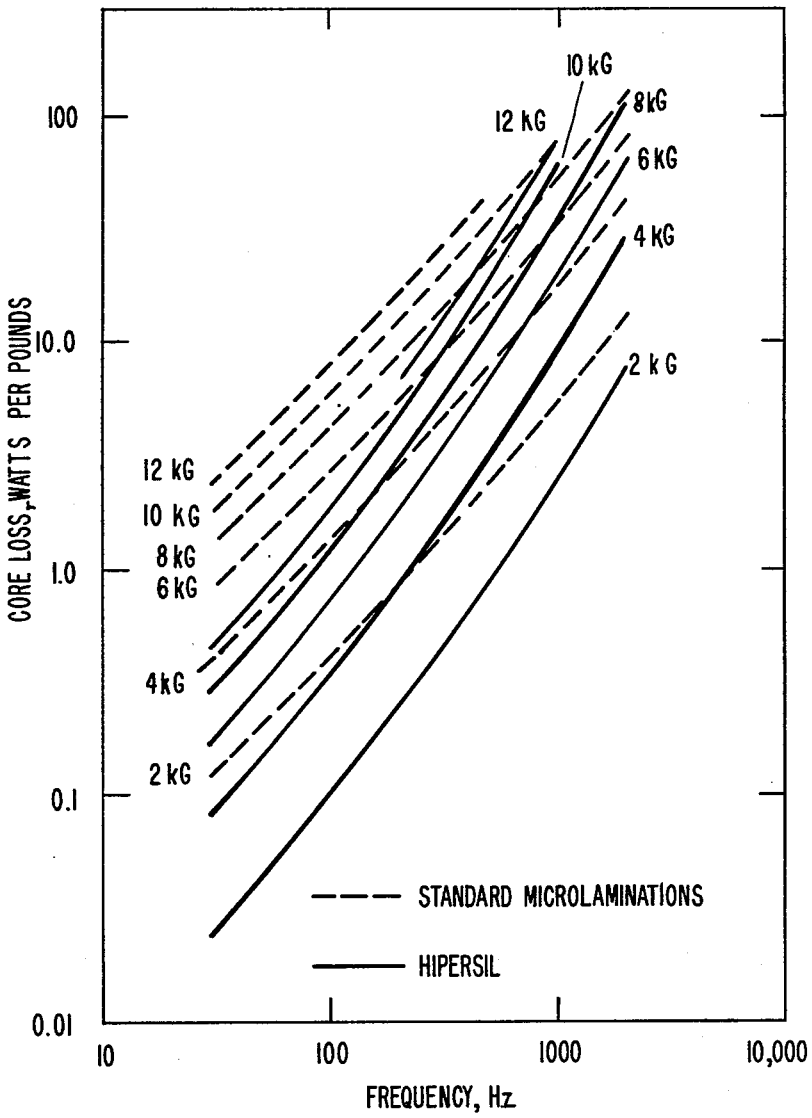
FIG. 3 is a graph illustrating the frequency dependence of core loss on low carbon steel microlaminations and iron-silicon microlaminations.

A comparison of the loss characteristics of the silicon steel microlamination test ring with the loss behavior of a standard low carbon steel microlamination compact is shown in FIG. 3. The 60 Hz loss characteristics indicate the loss behavior of the silicon iron compact is significantly better, at all levels of induction, than the standard low carbon steel microlamination sample. Also, the frequency dependence of the losses for both samples, FIG. 3, indicates the silicon steel sample is significantly better over the entire range of frequencies and inductions investigated. However, it should be noted from the slopes of the loss-frequency curves, that at frequencies substantially higher than those investigated, the core loss of the low carbon steel (AISI Type 1010) microlamination compact will be superior to the silicon steel sample, due to a lower eddy current loss component in the low carbon steel compact.

What is claimed is:

1. A method of making pressed magnetic core components having improved magnetic characteristics (a low core loss property) for use in electrical apparatus, comprising the steps of (a) providing silicon-iron alloy sheet stock having a thin coating of silicate glass on two opposite sides thereof and having a silicon content of from about 2.5% to 3.5%, a carbon content of up to 0.01%, manganese of from about 0.01% to 0.2%, and sulfur in the amount of from 0.005% to 0.25%, (b) forming microlaminations from the silicon-iron alloy sheet stock, which microlaminations comprise a coating of silicate glass on two opposite sides thereof, (c) coating the microlaminations with a dielectric material, (d) assembling the microlaminates within a mold of predetermined configuration, (e) compacting the microlaminates into a magnetizable compact, and (f) annealing the compacted microlaminates to relieve stresses.

2. The method of claim 1 in which the silicon content is from 2.75% to 3.3%.

3. The method of claim 2 in which the silicon content is about 3.2%.

4. The method of claim 1 in which the alloy stock is an oriented silicon steel.

5. The method of claim 1 in which the dielectric material is magnesium methylate.

6. The method of claim 1 in which the microlaminations are annealed at step (f) at a temperature between about 900° C. and about 950° C.

7. The method of claim 6 in which the temperature is between about 910° C. and about 940° C. at step (f).

8. The method of claim 7 in which the anneal temperature is about 925° C.

9. The method of claim 8 in which the anneal time is about 4 hours.

10. A method of producing pressed magnetic core components having improved magnetic characteristics (a low core loss property) for use in electrical apparatus, comprising the steps of (a) providing silicon-iron alloy sheet stock having a thin coating of silicate glass on two opposite sides thereof, (b) forming particles of predetermined size and shape from said silicon iron alloy having a silicon content of from about 2.5% to about 3.5%, a carbon content of up to 0.01%, manganese of from about 0.01% to 0.2%, and sulfur in the amount of from 0.005% to 0.25%, (c) annealing the particles in a deoxidizing atmosphere, (d) coating the microlaminations with a dielectric material, (e) assembling the particles within a container of predetermined configurations, (f) compacting the particles into a magnetizable compact, and (g) annealing the compact to relieve stresses.

11. The method of claim 10 in which dielectric material comprising magnesium methylate.

12. The method of claim 11 in which the annealing step (f) occurs for about 4 hours at about 925° C.

* * * * *

UNITED STATES PATENT AND TRADEMARK OFFICE

CERTIFICATE OF CORRECTION

PATENT NO. : 4,265,681

DATED : May 5, 1981

INVENTOR(S) : Robert F. Krause, Norman M. Pavlik & Kurt A. Grunert

It is certified that error appears in the above-identified patent and that said Letters Patent are hereby corrected as shown below:

Column 5, line 52, cancel "Armco, Inc." and substitute -- Westinghouse Electric Corporation --.

Signed and Sealed this

Tenth Day of November 1981

[SEAL]

*Attest:*

GERALD J. MOSSINGHOFF

*Attesting Officer*

*Commissioner of Patents and Trademarks*